US009761388B2

(12) United States Patent
Kitahara

(10) Patent No.: US 9,761,388 B2
(45) Date of Patent: Sep. 12, 2017

(54) PUSH SWITCH

(71) Applicant: Tokyo Parts Industrial Co., Ltd., Gunma (JP)

(72) Inventor: Takahisa Kitahara, Gunma (JP)

(73) Assignee: TOKYO PARTS INDUSTRIAL CO., LTD., Gunma (JP)

( * ) Notice: Subject to any disclaimer, the term of this patent is extended or adjusted under 35 U.S.C. 154(b) by 0 days.

(21) Appl. No.: 14/803,246

(22) Filed: Jul. 20, 2015

(65) Prior Publication Data

US 2017/0025235 A1 Jan. 26, 2017

(51) Int. Cl.

| | |
|---|---|
| ***H01H 3/12*** | (2006.01) |
| ***H01H 13/14*** | (2006.01) |
| ***H01H 13/06*** | (2006.01) |
| *H01H 9/04* | (2006.01) |

(52) U.S. Cl.

CPC ..... *H01H 13/06* (2013.01); *H01H 2009/048* (2013.01)

(58) Field of Classification Search

CPC ..... H01H 13/14; H01H 13/50

USPC ..... 200/520, 341, 275, 284

See application file for complete search history.

(56) References Cited

U.S. PATENT DOCUMENTS

| | | | | |
|---|---|---|---|---|
| 4,103,136 | A * | 7/1978 | Karakis | H01H 9/04 174/23 R |
| 7,683,278 | B2 * | 3/2010 | Kakita | H01H 13/06 200/302.2 |
| 2009/0229956 | A1 * | 9/2009 | Puri | H01H 13/365 200/275 |
| 2011/0284351 | A1 * | 11/2011 | Kitahara | H01H 13/06 200/341 |
| 2011/0284352 | A1 * | 11/2011 | Kitahara | H01H 13/06 200/341 |
| 2012/0006664 | A1 * | 1/2012 | Kitahara | H01H 13/06 200/341 |
| 2014/0158508 | A1 * | 6/2014 | Mittelstadt | H01H 1/50 200/284 |

FOREIGN PATENT DOCUMENTS

JP 2012-018794 A 1/2012

* cited by examiner

*Primary Examiner* — Renee S Luebke
*Assistant Examiner* — Lheiren Mae A Caroc
(74) *Attorney, Agent, or Firm* — Pearne & Gordon LLP

(57) ABSTRACT

A push switch is provided with a switch case, a push button, a switch component, a terminal member and a lead wire. The terminal member has a flat part and a first suspended part suspended from one end of the flat part. The flat part includes a first connecting part to which the connecting terminal is connected without soldering. The first suspended part includes a second connecting part to which the lead wire is connected without soldering. The switch case has first support part for supporting the lead wire which is inserted into the space, and second support part for supporting the flat part of the terminal member.

7 Claims, 6 Drawing Sheets

PUSH SWITCH

TECHNICAL FIELD

Field of the Invention

The present invention relates to a push switch using a soft push button.

Related Art

As a push switch using a soft push button, there is disclosed, for example, in Patent Document 1, a push switch including a switch component which is disposed on a base, a cylindrical case for containing the switch component, and a push button which is mounted on an upper part of the case.

In the push switch disclosed in Patent Document 1, a terminal of the switch component is connected to a terminal member which is attached to a lower face of the base, and a lead wire is connected to the terminal member. Accordingly, there is such advantage that a printed wiring board is not required.

Patent Document 1: JP-A-2012-018794

However, in the push switch disclosed in Patent Document 1, besides the cylindrical case for containing the switch component, it is necessary to prepare the base on which the switch component is disposed. Therefore, although the printed wiring board is not required, reduction of members is not sufficiently attained.

Moreover, in the push switch disclosed in Patent Document 1, it is necessary to connect the terminal of the switch to the terminal member by soldering, and also to connect the lead wire to the terminal member by soldering. For this reason, reduction of manufacturing time is not sufficiently attained.

SUMMARY OF THE INVENTION

One or more embodiments provide a push switch which can realize further reduction of members and facilitation of manufacturing.

Now, features of the embodiments will be described. It is to be noted that constituent elements which are adopted in the respective features as described below can be adopted in as more desired combination as possible. Features and technical characteristics of the invention are not limited to those described below, but are to be recognized on the basis of descriptions in the whole specification and drawings, or concept of the invention which can be grasped from these descriptions by those skilled in the art.

In accordance with one or more embodiments, a push switch is provided with: a switch case including a bottom face, a side face, and an upper face having an opening; a soft push button which is mounted on the switch case so as to close the opening; a switch component which is disposed in a space defined by the switch case and the push button, and has an operating part in an upper part thereof and a plurality of connecting terminals which are extended downward; a terminal member which is electrically connected to the connecting terminals; and a lead wire which is electrically connected to the terminal member. The terminal member has a flat part and a first suspended part suspended from one end of the flat part, wherein the flat part includes a first connecting part to which the connecting terminal is connected without soldering. Wherein the first suspended part includes a second connecting part to which the lead wire is connected without soldering. The switch case has a insertion hole which is formed on one of the side face for allowing the lead wire to be inserted into the space, a first support part for supporting the lead wire which are inserted into the space, and a second support part for supporting the flat part of the terminal member.

In the push switch having the above described structure, electrical connection between the terminal members, the lead wires, and the connecting terminals of the switch component can be easily conducted without soldering, and at the same time, the terminal members and the switch component are supported by the switch case. Therefore, it is possible to realize the push switch having high reliability, employing a small number of members.

The switch case may have a groove into which the first suspended part are inserted.

In the push switch having the above described structure, the terminal members can be easily positioned, and hence, it is possible to extremely easily conduct electrical connection between the second connecting parts of the terminal members and the lead wires.

The terminal member may have a second suspended part which is suspended from the other end of the flat part. The switch case may have a fixing part for fixing the second suspended part.

In the push switch having the above described structure, the terminal members can be rigidly fixed to the switch case, and hence, it is possible to realize the push switch having higher reliability.

The switch case may have a resin filling room which is so provided as to surround the insertion hole, and wherein the resin filling room is filled with resin.

In the push switch having the above described structure, intrusion of water into an internal space in which the switch component is disposed can be effectively prevented, and hence, it is possible to realize the push switch having high waterproofing performance.

According to the push switch of one or more embodiments, it is possible to easily conduct electrical connection between the terminal members, the lead wires, and the connecting terminals of the switch component without soldering, and at the same time, it is possible to realize the push switch having high reliability, employing a small number of members.

DETAILED DESCRIPTION OF THE EMBODIMENTS

Figure 1:
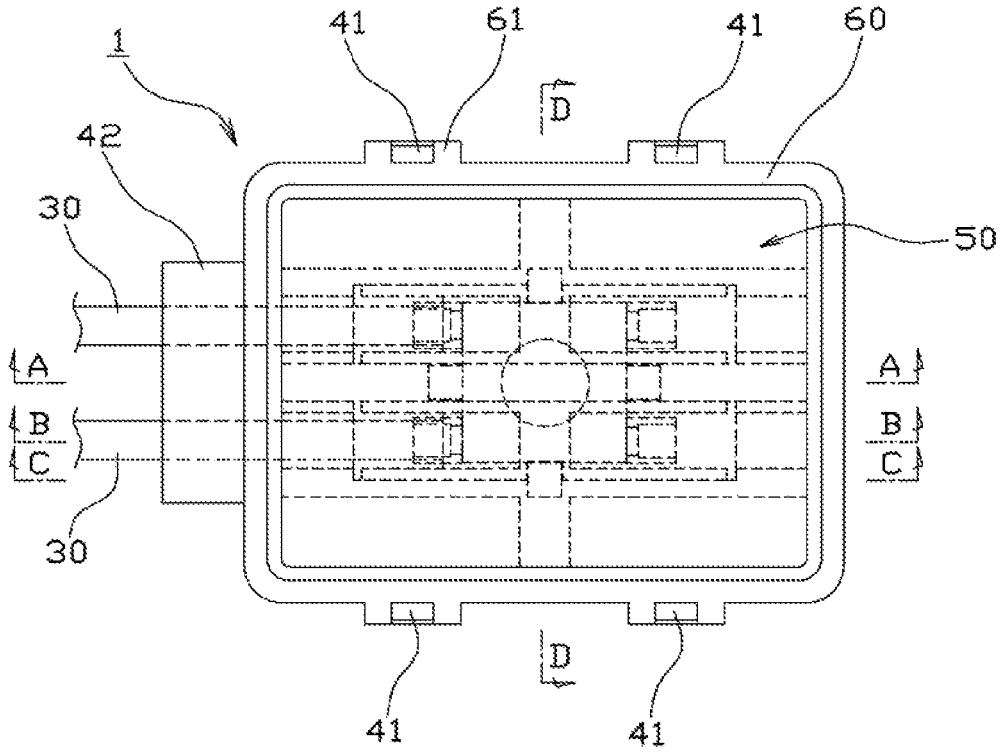
FIG. 1 is a plan view of a push switch in an embodiment.
Figure 2:
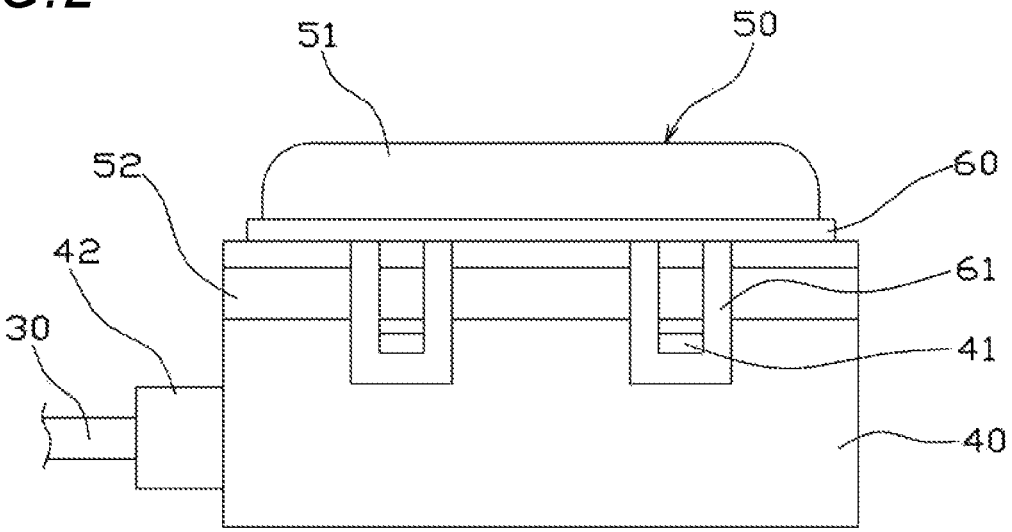
FIG. 2 is a front view of the push switch in FIG. 1.
Figure 3:
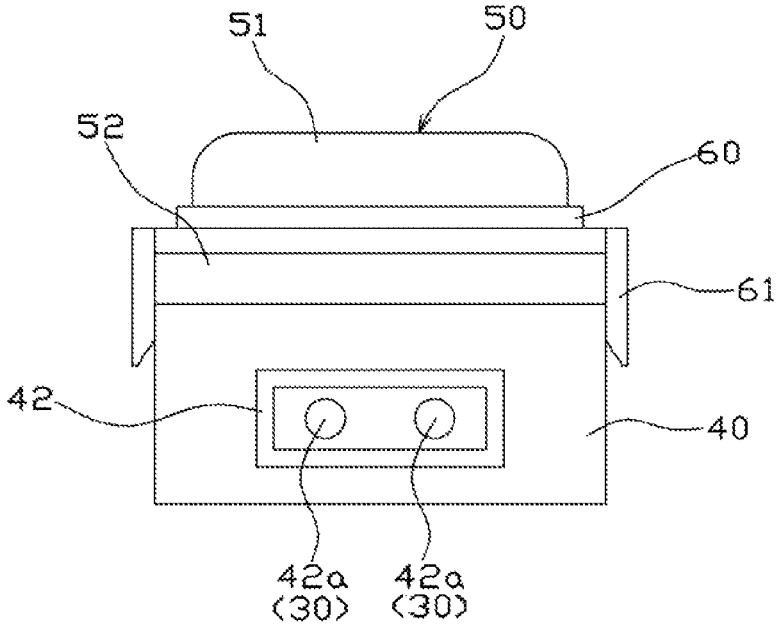
FIG. 3 is a left side view of the push switch in FIG. 1.
Figure 4:
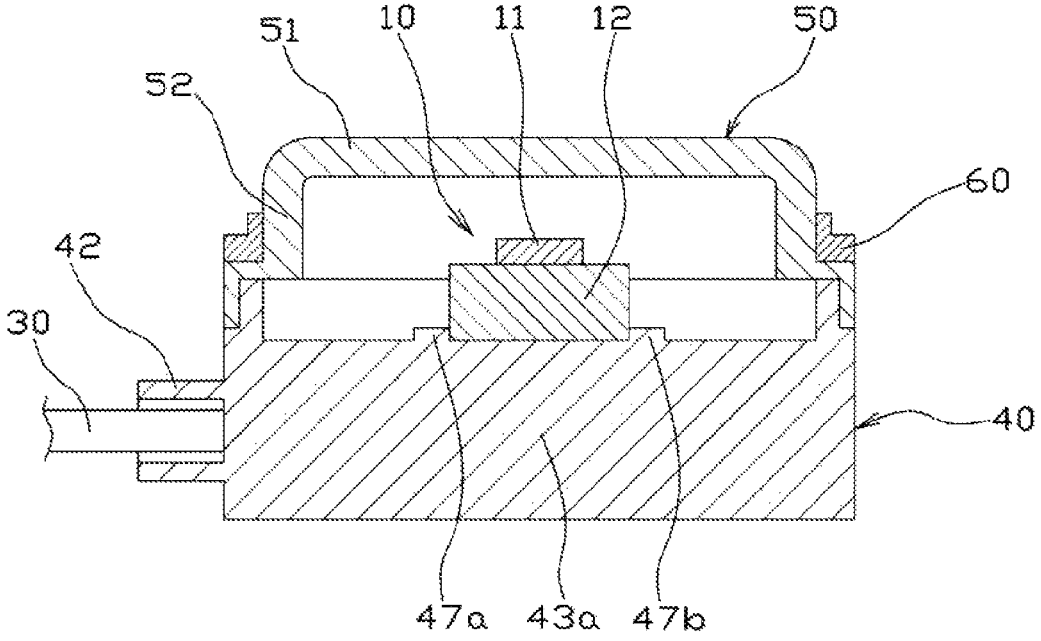
FIG. 4 is a sectional view as seen in a direction of arrows A-A in FIG. 1.
Figure 5:
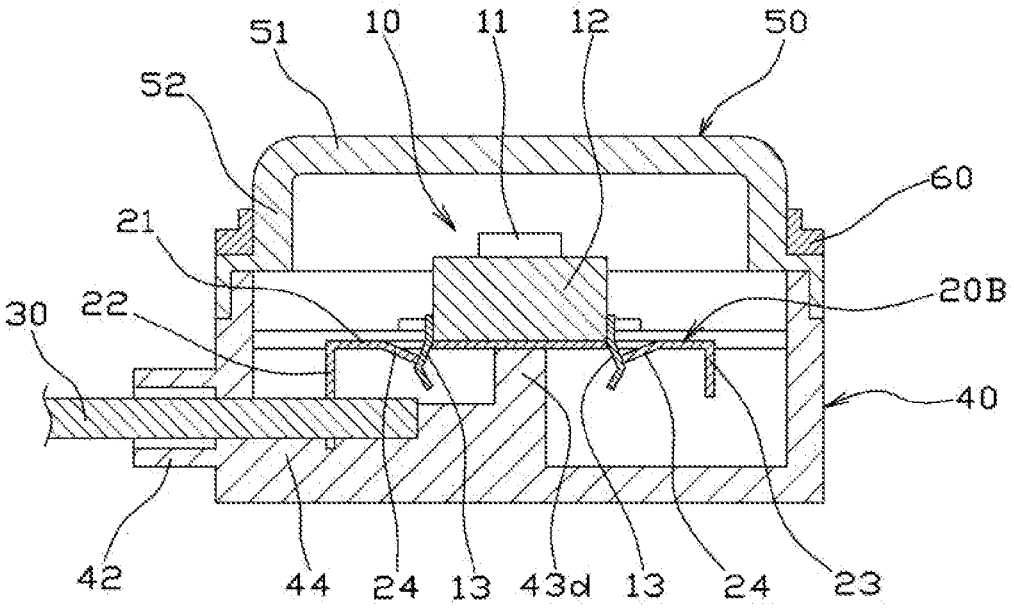
FIG. 5 is a sectional view as seen in a direction of arrows B-B in FIG. 1.
Figure 6:
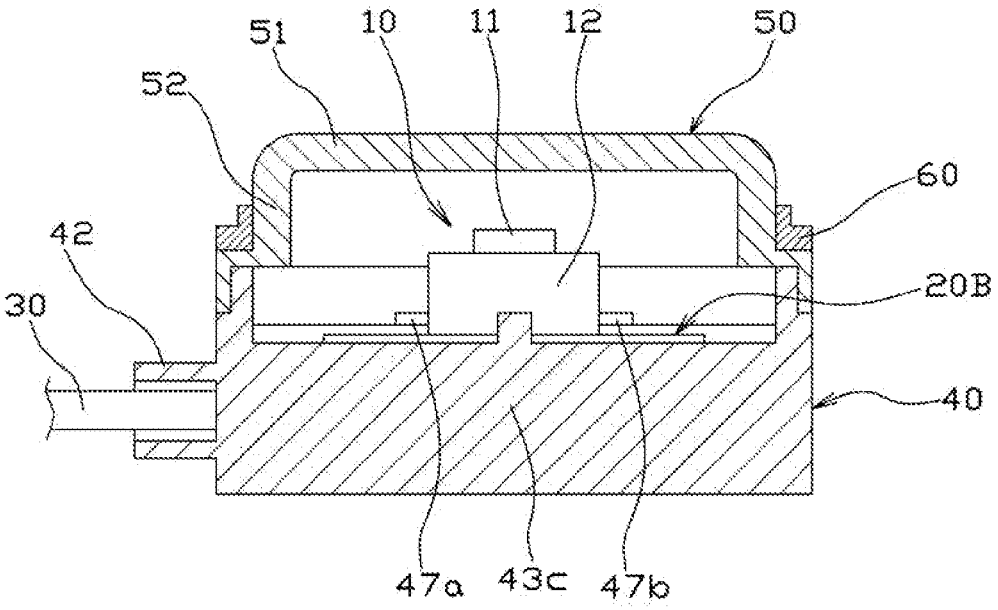
FIG. 6 is a sectional view as seen in a direction of arrows C-C in FIG. 1.

An embodiment of the invention will be described in detail, referring to the drawings.

Embodiment

According to an embodiment, a push switch 1 is mounted on a door handle device for a vehicle, which is not shown. When a user operates a door lock device, the user can lock or unlock the door, by pushing a push button 50 of the push switch 1 which is exposed from the door handle device for the vehicle.

This push switch 1 includes a switch component 10, two terminal members 20A, 20B, two lead wires 30, a switch case 40, the push button 50, and a cover member 60.

The switch component 10 has an operating part 11 in a columnar shape, a body part 12 in a cubic shape, and four connecting terminals 13. The operating part 11 which is projected upward from the body part 12 is so constructed as to move in a vertical direction in FIG. 7. The operating part 11 is urged upward in FIG. 7, by an elastic member, which is not shown, inside the body part 12. The connecting terminals 13 are extended downward from the body part 12.

This switch component 10 is disposed in a space which is defined by the switch case 40 and the push button 50, which will be described below.

The terminal members 20A, 20B are formed by working sheet metals having electrical conductivity, and each of the terminal members has a flat part 21, and a first suspended part 22 and a second suspended part 23 both of which are suspended from opposite ends of the flat part 21.

The flat part 21 is provided with first connecting parts 24 for electrically connecting the connecting terminal 13 of the switch component 10, without soldering. A tongue piece which is cut away in three directions into a cantilever shape is formed in each of the first connecting parts 24. This tongue piece is bent so as to be slightly inclined downward.

Moreover, the flat part 21 is formed with a cutout 26 to which guide walls 47*c*, 47*d* provided in the switch case 40, which will be described below, are to be fitted.

The first suspended part 22 is provided with a second connecting part 25 for electrically connecting the lead wire 30, without soldering. This second connecting part 25 is formed with a vertical slit having a rather smaller width than a diameter of a core wire of the lead wire 30, which is formed by covering the core wire with an insulating cover material.

The second suspended part 23 is shorter than the first suspended part 22, and formed in a slightly curved shape so that it can be fixed to a groove 46*b* in the switch case 40, which will be described below.

The switch case 40 is formed of hard resin, and integrally molded into a bottomed angular cylindrical shape, having a bottom face, side faces, and an upper face provided with an opening.

The switch case 40 is provided with locking hooks 41 for locking lock parts 61 of the cover member 60, which will be described below, in upper parts of the two opposed side faces thereof.

One of the side faces of the switch case 40 which is not provided with the locking hook 41 is formed with insertion holes 42*a* in a round shape, for allowing distal end portions of the two lead wires 30 to be inserted into the switch case. A diameter of this insertion hole 42*a* is slightly larger than a diameter of the lead wire 30.

Moreover, a resin filling room 42 is provided on the one side face of the switch case 40 so as to surround the insertion holes 42*a*. This resin filling room 42 has an angular cylindrical shape protruded outward from the one side face of the switch case 40, and will be filled with resin for waterproofing treatment, in a final stage.

Figure 8:
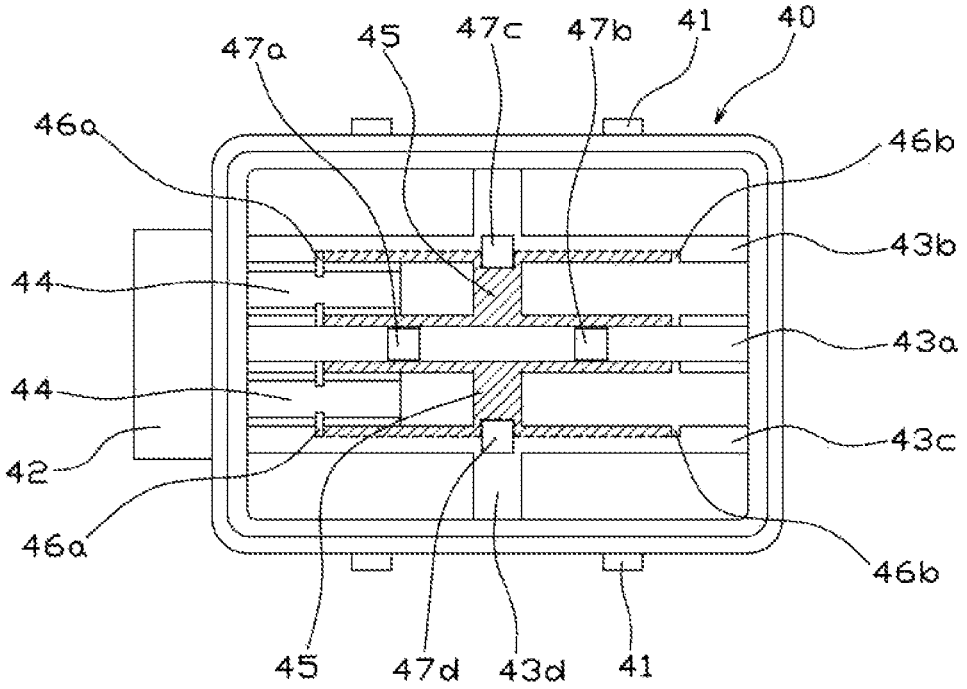
FIG. 8 is a plan view of a case of the push switch in FIG. 1.
Figure 9:
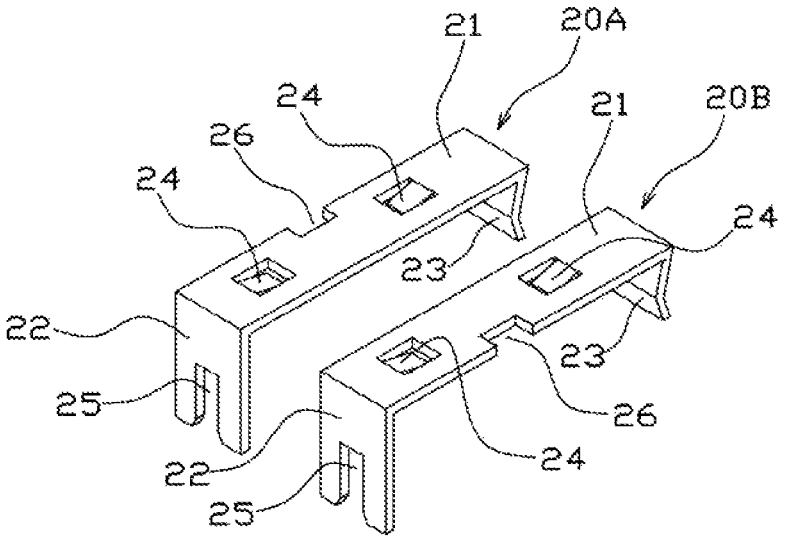
FIG. 9 is a perspective view of terminal members of the push switch in FIG. 1.

There are provided, inside the switch case 40, three upright walls 43*a*, 43*b*, 43*c* which are parallel to an inserting direction of the lead wires 30 (a lateral direction in FIG. 8), and one upright wall 43*d* which is perpendicular to the inserting direction of the lead wires 30.

First support parts 44 are provided, adjacent to the insertion holes 42*a*, between the upright wall 43*a* and the upright wall 43*b*, and between the upright wall 43*a* and the upright wall 43*c*. These first support parts 44 are the parts for supporting the distal end portions of the lead wires 30 which are inserted from the insertion holes 42*a*, and include grooves each having a slightly smaller width than the diameter of the lead wire 30. The distal end portions of the lead wires 30 are press-fitted to these first support parts 44 from the above.

A part of upper faces of the upright walls 43*a*, 43*b*, 43*c* (a hatched part in FIG. 8) is formed as second support parts 45 for supporting the flat parts 21 of the terminal members 20A, 20B.

The upright walls 43*a*, 43*b*, 43*c* are provided with grooves 46*a* into which the first suspended parts 22 of the terminal members 20A, 20B are inserted, and grooves 46*b* to which the second suspended parts 23 of the terminal members 20A, 20B are fixed. The grooves 46*a* are provided at respective intermediate positions of the first support parts 44, in the lateral direction in FIG. 8.

These grooves 46*a*, 46*b* are formed in a rectilinear shape, and respectively have such widths (widths in the lateral direction in FIG. 8) as corresponding to thicknesses of the first suspended parts 22 and the second suspended parts 23 of the terminal members 20A, 20B.

The upright walls 43*a*, 43*b*, 43*c* are provided with guide walls 47*a*, 47*b*, 47*c*, 47*d* for guiding side faces of the body part 12 of the switch component 10, on the upper faces thereof. It is to be noted that a center part of the upright wall 43*a* is partially formed higher, and the guide walls 47*a*, 47*b* are provided in this higher part.

The push button 50 is formed of soft resin having elasticity such as rubber, and includes an operating wall 51 on the top, and a side peripheral wall 52 which is suspended from a peripheral edge of the operating wall 51.

This push button 50 is mounted on an upper part of the switch case 40 so as to close the opening of the switch case 40. Specifically, the side peripheral wall 52 is fitted to a stepped part which is formed around an outer periphery of the switch case 40 in the upper part thereof, and further, the cover member 60 is fitted to an outer periphery of the side peripheral wall 52. Then, the lock parts 61 of the cover member 60 are locked by the locking hooks 41 of the switch case 40 thereby to fix the push button 50 and the cover member 60 to the switch case 40.

On occasion of mounting the push switch 1 to the door handle, which is not shown, the push switch 1 is mounted inside the door handle in such a manner that the operating wall 51 on the top of the push button 50 is exposed to the exterior.

Then, a process for assembling the push switch 1 in this embodiment will be described.

Figure 10:
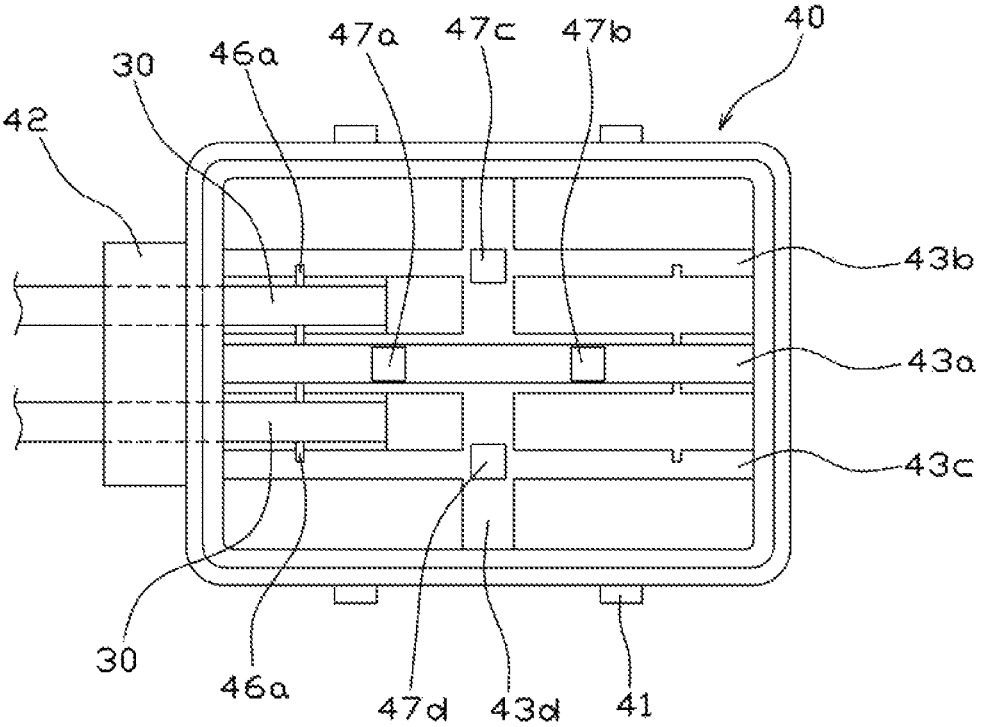
FIG. 10 is a plan view for explaining assembling steps of the push switch in FIG. 1.

As a first step, the two lead wires 30 are inserted into the switch case 40 through the insertion holes 42*a*. Then, the distal end portions of the lead wires 30 are pressed from the above and press-fitted to the first support parts 44 (See FIG. 10). As the results, the lead wires 30 are fixed to the switch case 40 and will not be easily detached.

Figure 11:
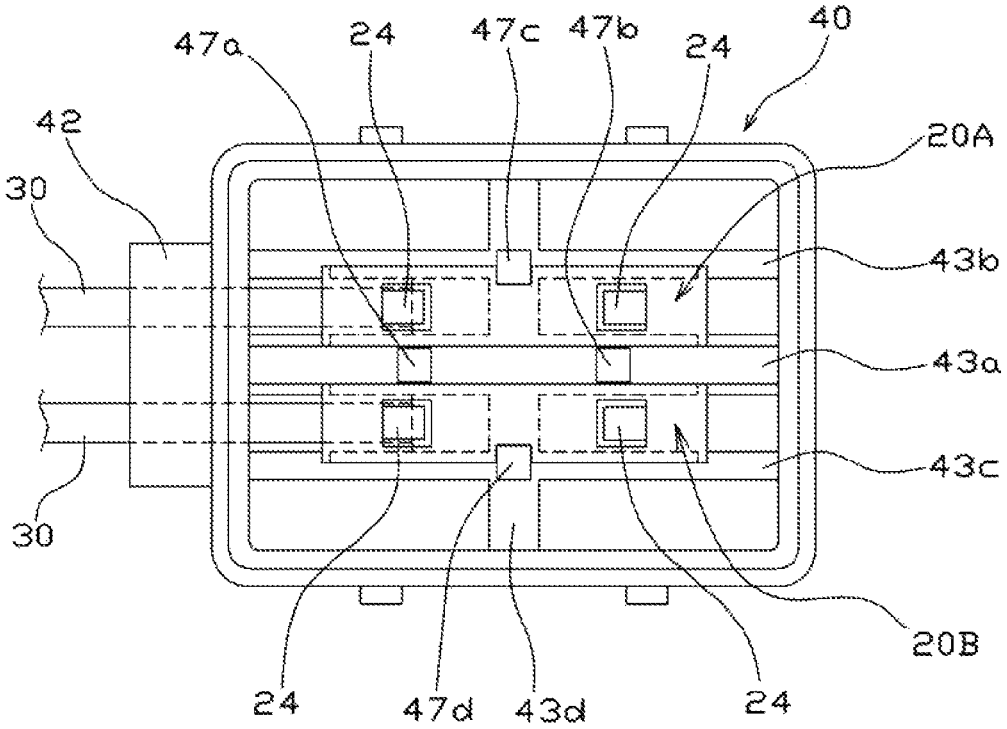
FIG. 11 is a plan view for explaining the assembling steps of the push switch in FIG. 1.

Then, the first suspended parts 22 and the second suspended parts 23 of the terminal members 20A, 20B are respectively fitted into the grooves 46*a*, 46*b* of the switch case 40 (See FIG. 11).

When the first suspended parts 22 of the terminal members 20A, 20B are fitted into the grooves 46*a*, the distal end portions of the lead wires 30 are fitted into the second connecting parts 25 respectively having the vertical slits, which are formed in the first suspended parts 22. On this occasion, because each of the slits in the second connecting parts 25 has the rather smaller width than the diameter of the core wire of the lead wire 30, both side parts of the slit of the second connecting part 25 bite the insulating cover material of the lead wire 30. In this manner, the core wires of the lead wires 30 are electrically connected to the terminal members 20A, 20B.

Moreover, when the second suspended parts 23 of the terminal members 20A, 20B are fitted into the grooves 46*b*, the second suspended parts 23 which are slightly curved are deformed according to the rectilinear shape of the grooves 46*b*. As the results, due to an elastic force caused by deformation of the second suspended parts 23, the terminal members 20A, 20B are fixed to the switch case 40, and will not float to be detached from the switch case 40. In this manner, the grooves 46*b* of the switch case 40 function as fixing parts for fixing the terminal members 20A, 20B.

Moreover, when the first suspended parts 22 and the second suspended parts 23 of the terminal members 20A, 20B are respectively fitted into the grooves 46*a* and the grooves 46*b*, the flat parts 21 are placed on the second support parts 45 of the switch case 40. At the same time, the guide walls 47*c*, 47*d* are partially fitted into the cutouts 26. In this manner, the terminal members 20A, 20B are fixed to the switch case 40 in a stabilized manner, without causing positional deviation in a horizontal direction and floating in a vertical direction.

Figure 12:
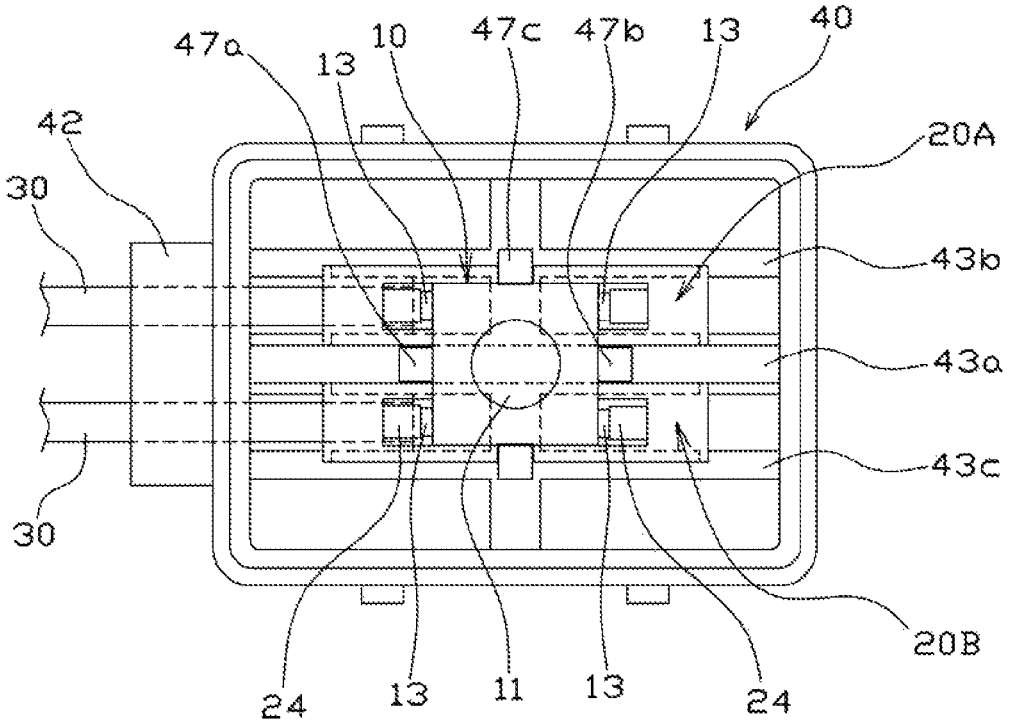
FIG. 12 is a plan view for explaining the assembling steps of the push switch in FIG. 1.

Then, the switch component 10 is incorporated into the switch case 40. Specifically, the four connecting terminals 13 of the switch component 10 are inserted into the four first connecting parts 24 in total which are respectively formed on the flat parts 21 of the terminal members 20A, 20B (See FIG. 12).

When the connecting terminals 13 are inserted into the first connecting parts 24, the tongue pieces of the first connecting parts 24 are deformed downward. Due to elastic forces caused by this deformation, the connecting terminals 13 are pressed with the tongue pieces and fixed, so that the connecting terminals 13 are electrically connected to the terminal members 20A, 20B.

Moreover, when the connecting terminals 13 are inserted into the first connecting parts 24, the body part 12 in a cubic shape of the switch component 10 is surrounded with the guide walls 47*a*, 47*b*, 47*c*, 47*d* of the switch case 40 in a tight contact state. In this manner, the side faces in the four directions of the switch component 10 are constrained, and backlash of the switch component 10 can be prevented. As the results, it is possible to enhance reliability of the electrical continuity between the connecting terminals 13 and the terminal members 20A, 20B.

Then, the push button 50 is mounted on the switch case 40 so as to close the opening of the switch case 40, and thereafter, the cover member 60 is mounted. Finally, resin (not shown) is filled in the resin filling room 42 of the switch case 40.

Figure 7:
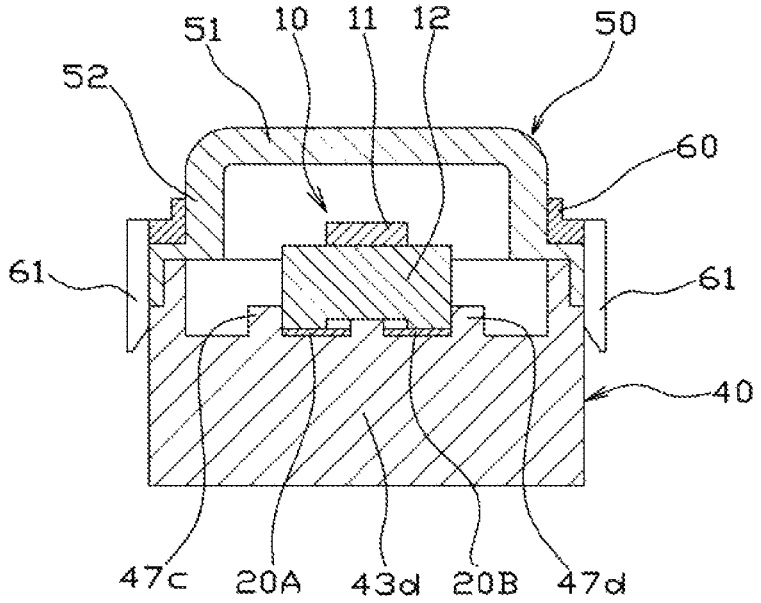
FIG. 7 is a sectional view as seen in a direction of arrows D-D in FIG. 1.

In the push switch 1 in this embodiment which is so constructed as described above, when the operating wall 51 on the top of the push button 50 is pressed downward from the above in FIG. 7, the operating wall 51 is elastically deformed, and pushes the operating part 11 of the switch component 10 downward. As the results, the switch is turned on, and signals are transmitted to the exterior by way of the lead wires 30.

Moreover, when the pushing operation of the operating wall 51 is released, the original state is recovered by a restoring force of the soft push button 50, and the operating part 11 of the switch component 10 is also returned to the upper position. As the results, the switch is turned off.

According to the push switch 1 in this embodiment which has been heretofore described, it is possible to electrically connect the connecting terminals 13 of the switch component 10 to the lead wires 30, without soldering, by means of the first connecting parts 24 and the second connecting parts 25 which are formed in the terminal members 20A, 20B.

Moreover, the switch case 40 has the first support parts 44 for constraining the distal end portions of the lead wires 30 which are inserted into the switch case 40. Therefore, the lead wires 30 are prevented from juggling, when the terminal members 20A, 20B are pushed in. As the results, it is possible to easily conduct the electrical connection between the second connecting parts 25 and the lead wires 30 with high reliability.

Moreover, the flat parts 21 of the terminal members 20A, 20B are supported by the second support parts 45 of the switch case 40, and at the same time, the lead wires 30 whose distal end portions are constrained by the first support parts 44 are fitted into the second connecting parts 25 of the terminal members 20A, 20B. Therefore, when the connecting terminals 13 of the switch component 10 are pushed into the first connecting parts 24, the terminal members 20A, 20B are prevented from flexing or juggling. As the results, it is possible to easily conduct the electrical connection between the first connecting parts 24 of the terminal members 20A, 20B and the connecting terminals 13 of the switch component 10 with high reliability.

In this manner, according to this embodiment, it is possible to realize the push switch having high reliability, using a small number of members, while realizing facilitation of manufacturing, without requiring soldering connection.

Moreover, in the push switch 1 in this embodiment, the switch case 40 is provided with the grooves 46*a* to which the first suspended parts 22 of the terminal members 20A, 20B are fitted. Therefore, the terminal members 20A, 20B can be easily positioned, and hence, it is possible to extremely easily conduct the electrical connection between the second connecting parts 25 and the lead wires 30.

Further, in the push switch 1 in this embodiment, the switch case 40 is provided with the grooves 46*b* to which the second suspended parts 23 of the terminal members 20A, 20B are fitted and fixed. Therefore, the terminal members 20A, 20B can be rigidly fixed to the switch case 40, and hence, it is possible to realize the push switch having higher reliability.

Still further, in the push switch 1 in this embodiment, the resin is filled in the resin filling room 42 which is so formed as to surround the insertion holes 42*a* into which the lead wires 30 are inserted. Therefore, intrusion of water into the switch case 40 in which the switch component 10 is disposed can be effectively prevented, and hence, it is possible to realize the push switch having excellent waterproofing performance.

Although the one embodiment of the invention has been heretofore described, the invention is not limited to the embodiment as described above. It is needless to say that appropriate modifications can be made, within a scope not deviating from the gist of the invention.

Specifically, as to the first connecting parts 24 which are provided in the terminal members 20A, 20B, for example, it is possible to adopt the tongue pieces having any desired shape, provided that the tongue pieces have such a shape as electrically connectable to the connecting terminals 13 without soldering.

Moreover, as to the second connecting parts 25 which are provided in the terminal members 20A, 20B, it is possible to adopt the slits or cutouts having any desired shape, provided that the slits or cutout have such a shape as electrically connectable to the lead wires 30 without soldering.

Further, as to the shape of the first support parts 44 of the switch case 40, such a shape that the distal end portions of the lead wires 30 can be fixed by press-fitting them from the above is simple and reliable, and hence, preferable. However, it is also possible to adopt such a shape that the distal end portions of the lead wires 30 are simply supported from the below or simply inserted.

Moreover, as to the structure for fixing the terminal members 20A, 20B to the switch case 40, a manner of utilizing the elastic force caused by the deformation of the second suspended parts 23 is simple, and hence, preferable. However, it is also possible to adopt a manner of providing locking hooks for locking the terminal members, on the switch case 40, or a manner of simply press-fitting respective one portions of the terminal members to the switch case 40. Moreover, for the purpose of fixing the terminal members 20A, 20B more reliably, it is also preferable that the first suspended parts 22 may be so shaped as to be slightly curved in the same manner as the second suspended parts 23, so that the first suspended parts 22 can be fixed to the grooves 46*a* of the switch case 40.

What is claimed is:

1. A push switch comprising:

a switch case comprising hard resin integrally molded into a bottomed cylindrical shape, and including a bottom face, a side face, and an upper face having an opening which is located on only the upper face;

a soft push button which is mounted on the switch case so as to close the opening;

a switch component which is disposed in a space defined by the switch case and the push button, and has an operating part in an upper part thereof and a plurality of connecting terminals which are extended downward;

a terminal member which is electrically connected to the connecting terminals; and a lead wire which is electrically connected to the terminal member, wherein the terminal member has a flat part and a first suspended part suspended from one end of the flat part, wherein the flat part includes a first connecting part to which the connecting terminal is connected without soldering, and wherein the first suspended part includes a second connecting part to which the lead wire is connected without soldering, wherein the switch case has an insertion hole which is formed on the side face for allowing the lead wire to be inserted into the space, a first support part for supporting a distal end of the lead wire which is inserted into the space, and a second support part for supporting the flat part of the terminal member from below, and wherein the switch component is mounted on the flat part of the terminal member.

2. The push switch according to claim 1, wherein the switch case has a groove into which the first suspended part is inserted.

3. The push switch according to claim 1, wherein the terminal member has a second suspended part which is suspended from the other end of the flat part, and wherein the switch case has a fixing part for fixing the second suspended part.

4. The push switch according to claim 1, wherein the first connecting part includes a tongue piece which is cut away in three directions into a cantilever shape, and wherein the tongue piece is bent so as to be inclined downward.

5. The push switch according to claim 1, wherein the second connecting part includes a vertical slit having a smaller width than a diameter of a core wire of the lead wire.

6. The push switch according to claim 1, wherein the switch case includes a guide wall, wherein the flat part includes a cutout, and wherein the guide wall is partially fitted into the cutout.

7. The push switch according to claim 1, wherein the switch case has a resin filling room which is so provided as to surround the insertion hole, and wherein the resin filling room is filled with resin.

* * * * *